US011170647B2

(12) United States Patent
Raichelgauz

(10) Patent No.: US 11,170,647 B2
(45) Date of Patent: Nov. 9, 2021

(54) DETECTION OF VACANT PARKING SPACES

(71) Applicant: CARTICA AI LTD., Tel Aviv (IL)

(72) Inventor: Igal Raichelgauz, Tel Aviv (IL)

(73) Assignee: CARTICA AI LTD., Tel Aviv (IL)

( * ) Notice: Subject to any disclaimer, the term of this patent is extended or adjusted under 35 U.S.C. 154(b) by 0 days.

(21) Appl. No.: 16/780,929

(22) Filed: Feb. 4, 2020

(65) Prior Publication Data

US 2020/0258387 A1 Aug. 13, 2020

Related U.S. Application Data

(60) Provisional application No. 62/802,408, filed on Feb. 7, 2019.

(51) Int. Cl.
*G08G 1/14* (2006.01)

(52) U.S. Cl.
CPC ..... *G08G 1/143* (2013.01); *G08G 1/147* (2013.01)

(58) Field of Classification Search
CPC .. G08G 1/052; G08G 1/096791; G08G 1/147; G08G 1/148; G08G 1/015; G08G 1/065; G08G 1/13; G08G 1/143; G08G 1/144; G08G 1/146; H04L 67/12; H04W 4/026; H04W 4/027; H04W 4/12; H04W 4/40; H04W 4/46; H04W 52/04; H04W 72/005; H04W 76/14; H04W 76/40; G01C 21/3469; G01C 21/3685; G06Q 10/02; G06Q 10/06393; G06Q 50/26;
(Continued)

(56) References Cited

U.S. PATENT DOCUMENTS 6,640,015 B1 10/2003 Lafruit
7,801,893 B2 9/2010 Gulli
(Continued)

FOREIGN PATENT DOCUMENTS

EP 1085464 A3 1/2007

OTHER PUBLICATIONS

Jasinschi et al., A Probabilistic Layered Framework for Integrating Multimedia Content and Context Information, 2002, IEEE, p. 2057-2060. (Year: 2002).
(Continued)

*Primary Examiner* — Daniel Previl
(74) *Attorney, Agent, or Firm* — Reches Patent

(57) ABSTRACT

A method for detecting allowable street parking slots, the method may include (i) receiving, by a computerized allowable street parking slot locating (CASPSL) system, street static vehicles information from multiple vehicles; wherein the street static vehicle information is indicative of (a) locations of static vehicles that are located at least partially within one or more streets, (b) relationship information indicative of spatial relationships between the static vehicles and the one or more street borders; and (c) timing information regarding timings of sensing of the static vehicles; and (ii) determining, by the CASPSL system, based on the street static vehicle information, allowable street parking slots metadata indicative of (a) locations of allowable street parking slots, and (b) time windows of allowed parking in the allowable street parking slot, and (c) spatial relationships between the static vehicles and the one or more street borders.

22 Claims, 9 Drawing Sheets

(58) Field of Classification Search
CPC ..... G07F 17/246; G07F 17/145; G07F 17/24; G07F 1/02; G07F 9/06; B60J 11/00; B60R 25/066; B62D 53/0878; E01C 19/4813; E01C 1/002; E01H 1/042; E01H 1/053; F16N 31/006; Y10S 194/90; Y10S 194/902; Y10T 70/5938; Y10T 74/11
USPC ..... 340/932.2, 935–939, 969, 990–995.11, 340/426.22, 438–439, 691.6
See application file for complete search history.

(56) References Cited

U.S. PATENT DOCUMENTS

| | | | |
|---|---|---|---|
| 8,275,764 | B2 | 9/2012 | Jeon |
| RE44,225 | E | 5/2013 | Aviv |
| 8,527,978 | B1 | 9/2013 | Sallam |
| 8,634,980 | B1 | 1/2014 | Urmson |
| 8,781,152 | B2 | 7/2014 | Momeyer |
| 8,782,077 | B1 | 7/2014 | Rowley |
| 9,298,763 | B1 | 3/2016 | Zack |
| 9,440,647 | B1 | 9/2016 | Sucan |
| 9,734,533 | B1 | 8/2017 | Givot |
| 10,133,947 | B2 | 11/2018 | Yang |
| 10,347,122 | B2 | 7/2019 | Takenaka |
| 10,491,885 | B1 | 11/2019 | Hicks |
| 2001/0019633 | A1 | 9/2001 | Tenze et al. |
| 2001/0034219 | A1 | 10/2001 | Hewitt et al. |
| 2001/0038876 | A1 | 11/2001 | Anderson |
| 2002/0004743 | A1 | 1/2002 | Kutaragi et al. |
| 2002/0010682 | A1 | 1/2002 | Johnson |
| 2002/0010715 | A1 | 1/2002 | Chinn et al. |
| 2002/0019881 | A1 | 2/2002 | Bokhari et al. |
| 2003/0037010 | A1 | 2/2003 | Schmelzer |
| 2004/0059736 | A1 | 3/2004 | Willse |
| 2004/0091111 | A1 | 5/2004 | Levy |
| 2004/0230572 | A1 | 11/2004 | Omoigui |
| 2005/0193015 | A1 | 9/2005 | Logston |
| 2006/0100987 | A1 | 5/2006 | Leurs |
| 2006/0120626 | A1 | 6/2006 | Perlmutter |
| 2006/0251339 | A1 | 11/2006 | Gokturk |
| 2007/0196013 | A1 | 8/2007 | Li |
| 2008/0109433 | A1 | 5/2008 | Rose |
| 2008/0152231 | A1 | 6/2008 | Gokturk |
| 2008/0166020 | A1 | 7/2008 | Kosaka |
| 2008/0270569 | A1 | 10/2008 | McBride |
| 2008/0294278 | A1 | 11/2008 | Borgeson |
| 2009/0022472 | A1 | 1/2009 | Bronstein |
| 2009/0034791 | A1 | 2/2009 | Doretto |
| 2009/0043818 | A1 | 2/2009 | Raichelgauz |
| 2009/0080759 | A1 | 3/2009 | Bhaskar |
| 2009/0216761 | A1 | 8/2009 | Raichelgauz |
| 2009/0278934 | A1 | 11/2009 | Ecker |
| 2010/0042646 | A1 | 2/2010 | Raichelgauz |
| 2010/0082684 | A1 | 4/2010 | Churchill |
| 2010/0111408 | A1 | 5/2010 | Matsuhira |
| 2010/0306193 | A1 | 12/2010 | Pereira |
| 2011/0029620 | A1 | 2/2011 | Bonforte |
| 2011/0038545 | A1 | 2/2011 | Bober |
| 2011/0246566 | A1 | 10/2011 | Kashef |
| 2012/0133497 | A1 | 5/2012 | Sasaki |
| 2012/0179751 | A1 | 7/2012 | Ahn |
| 2013/0103814 | A1 | 4/2013 | Carrasco |
| 2013/0212493 | A1 | 8/2013 | Krishnamurthy |
| 2013/0226820 | A1 | 8/2013 | Sedota, Jr. |
| 2014/0025692 | A1 | 1/2014 | Pappas |
| 2014/0059443 | A1 | 2/2014 | Tabe |
| 2014/0095425 | A1 | 4/2014 | Sipple |
| 2014/0111647 | A1 | 4/2014 | Atsmon |
| 2014/0201330 | A1 | 7/2014 | Lozano Lopez |
| 2014/0379477 | A1 | 12/2014 | Sheinfeld |
| 2015/0033150 | A1 | 1/2015 | Lee |
| 2015/0117784 | A1 | 4/2015 | Lin |
| 2015/0134688 | A1 | 5/2015 | Jing |
| 2015/0363644 | A1 | 12/2015 | Wnuk |
| 2016/0063862 | A1* | 3/2016 | Rosen ..... G08G 1/144 340/932.2 |
| 2016/0171785 | A1* | 6/2016 | Banatwala ..... G08G 1/146 705/13 |
| 2016/0210525 | A1 | 7/2016 | Yang |
| 2016/0221592 | A1 | 8/2016 | Puttagunta |
| 2016/0307048 | A1* | 10/2016 | Krishnamoorthy ..... G06T 7/70 |
| 2016/0342683 | A1 | 11/2016 | Kwon |
| 2016/0357188 | A1 | 12/2016 | Ansari |
| 2017/0032257 | A1 | 2/2017 | Sharifi |
| 2017/0041254 | A1 | 2/2017 | Agara Venkatesha Rao |
| 2017/0109602 | A1 | 4/2017 | Kim |
| 2017/0255620 | A1 | 9/2017 | Raichelgauz |
| 2017/0262437 | A1 | 9/2017 | Raichelgauz |
| 2017/0323568 | A1 | 11/2017 | Inoue |
| 2018/0081368 | A1 | 3/2018 | Watanabe |
| 2018/0101177 | A1 | 4/2018 | Cohen |
| 2018/0157916 | A1 | 6/2018 | Doumbouya |
| 2018/0158323 | A1 | 6/2018 | Takenaka |
| 2018/0204111 | A1 | 7/2018 | Zadeh |
| 2018/0286239 | A1* | 10/2018 | Kaloyeros ..... G08G 1/144 |
| 2018/0300654 | A1* | 10/2018 | Prasad ..... G06Q 10/02 |
| 2019/0005726 | A1* | 1/2019 | Nakano ..... G06T 19/006 |
| 2019/0039627 | A1 | 2/2019 | Yamamoto |
| 2019/0043274 | A1 | 2/2019 | Hayakawa |
| 2019/0045244 | A1 | 2/2019 | Balakrishnan |
| 2019/0056718 | A1 | 2/2019 | Satou |
| 2019/0065951 | A1* | 2/2019 | Luo ..... H04W 4/40 |
| 2019/0188501 | A1 | 6/2019 | Ryu |
| 2019/0220011 | A1* | 7/2019 | Della Penna ..... G08G 1/0133 |
| 2019/0236954 | A1* | 8/2019 | Komura ..... B62D 15/0285 |
| 2019/0317513 | A1 | 10/2019 | Zhang |
| 2019/0364492 | A1 | 11/2019 | Azizi |
| 2019/0384303 | A1 | 12/2019 | Muller |
| 2019/0384312 | A1* | 12/2019 | Herbach ..... G05D 1/0038 |
| 2019/0385460 | A1 | 12/2019 | Magzimof |
| 2019/0389459 | A1 | 12/2019 | Berntorp |
| 2019/0392710 | A1* | 12/2019 | Kapoor ..... G08G 1/148 |
| 2020/0004248 | A1 | 1/2020 | Healey |
| 2020/0004251 | A1 | 1/2020 | Zhu |
| 2020/0004265 | A1 | 1/2020 | Zhu |
| 2020/0005631 | A1 | 1/2020 | Visintainer |
| 2020/0018606 | A1* | 1/2020 | Wolcott ..... G01C 21/3602 |
| 2020/0018618 | A1 | 1/2020 | Ozog |
| 2020/0020212 | A1 | 1/2020 | Song |
| 2020/0050973 | A1 | 2/2020 | Stenneth |
| 2020/0073977 | A1 | 3/2020 | Montemerlo |
| 2020/0090484 | A1 | 3/2020 | Chen |
| 2020/0097756 | A1 | 3/2020 | Hashimoto |
| 2020/0133307 | A1* | 4/2020 | Kelkar ..... G06K 9/00791 |
| 2020/0043326 | A1 | 6/2020 | Tao |

OTHER PUBLICATIONS

Jones et al., "Contextual Dynamics of Group-Based Sharing Decisions", 2011, University of Bath, p. 1777-1786. (Year: 2011).
Iwamoto, "Image Signature Robust to Caption Superimpostion for Video Sequence Identification", IEEE, pp. 3185-3188 (Year: 2006).
Cooperative Multi-Scale Convolutional Neural, Networks for Person Detection, Markus Eisenbach, Daniel Seichter, Tim Wengefeld, and Horst-Michael Gross Ilmenau University of Technology, Neuroinformatics and Cognitive Robotics Lab (Year; 2016).
Chen, Yixin, James Ze Wang, and Robert Krovetz. "CLUE: cluster-based retrieval of images by unsupervised learning." IEEE transactions on Image Processing 14.8 (2005); 1187-1201. (Year: 2005).
Wusk et al (Non-Invasive detection of Respiration and Heart Rate with a Vehicle Seat Sensor; www.mdpi.com/journal/sensors; Published: May 8, 2018). (Year: 2018).
Chen, Tiffany Yu-Han, et al. "Glimpse: Continuous, real-time object recognition on mobile devices." Proceedings of the 13th ACM Confrecene on Embedded Networked Sensor Systems. 2015. (Year: 2015).
"Computer Vision Demonstration Website", Electronics and Computer Science, University of Southampton, 2005, USA.
Big Bang Theory Series 04 Episode 12, aired Jan. 6, 2011; [retrieved from Internet: ].

(56) References Cited

OTHER PUBLICATIONS

Boari et al, "Adaptive Routing for Dynamic Applications in Massively Parallel Architectures", 1995 IEEE, Spring 1995, pp. 1-14.
Burgsteiner et al., "Movement Prediction from Real-World Images Using a Liquid State machine", Innovations in Applied Artificial Intelligence Lecture Notes in Computer Science, Lecture Notes in Artificial Intelligence, LNCS, Springer-Verlag, BE, vol. 3533, Jun. 2005, pp. 121-130.
Cernansky et al, "Feed-forward Echo State Networks", Proceedings of International Joint Conference on Neural Networks, Montreal, Canada, Jul. 31-Aug. 4, 2005, pp. 1-4.
Chinchor, Nancy A. et al.; Multimedia Analysis + Visual Analytics = Multimedia Analytics; IEEE Computer Society; 2010; pp. 52-60. (Year: 2010).
Fathy et al, "A Parallel Design and Implementation For Backpropagation Neural Network Using MIMD Architecture", 8th Mediterranean Electrotechnical Conference, 19'96. MELECON '96, Date of Conference: May 13-16, 1996, vol. 3 pp. 1472-1475, vol. 3.
Freisleben et al, "Recognition of Fractal Images Using a Neural Network", Lecture Notes in Computer Science, 1993, vol. 6861, 1993, pp. 631-637.
Garcia, "Solving the Weighted Region Least Cost Path Problem Using Transputers", Naval Postgraduate School, Monterey, California, Dec. 1989.
Guo et al, AdOn: An Intelligent Overlay Video Advertising System (Year: 2009).
Hogue, "Tree Pattern Inference and Matching for Wrapper Induction on the World Wide Web", Master's Thesis, Massachusetts Institute of Technology, Jun. 2004, pp. 1-106.
Howlett et al, "A Multi-Computer Neural Network Architecture in a Virtual Sensor System Application", International Journal of knowledge-based intelligent engineering systems, 4 (2). pp. 86-93, 133N 1327-2314.
Hua et al., "Robust Video Signature Based on Ordinal Measure", Image Processing, 2004, 2004 International Conference on Image Processing (ICIP), vol. 1, IEEE, pp. 685-688, 2004.
International Search Report and Written Opinion for PCT/US2016/050471, ISA/RU, Moscow, RU, dated May 4, 2017.
International Search Report and Written Opinion for PCT/US2016/054634, ISA/RU, Moscow, RU, dated Mar. 16, 2017.
International Search Report and Written Opinion for PCT/US2017/015831, ISA/RU, Moscow, RU, dated Apr. 20, 2017.
Johnson et al, "Pulse-Coupled Neural Nets: Translation, Rotation, Scale, Distortion, and Intensity Signal Invariance for Images", Applied Optics, vol. 33, No. 26, 1994, pp. 6239-6253.
Lau et al., "Semantic Web Service Adaptation Model for a Pervasive Learning Scenario", 2008 IEEE Conference on Innovative Technologies in Intelligent Systems and Industrial Applications, 2008, pp. 98-103.
Li et al ("Matching Commercial Clips from TV Streams Using a Unique, Robust and Compact Signature" 2005) (Year: 2005).
Lin et al., "Generating robust digital signature for image/video authentication", Multimedia and Security Workshop at ACM Multimedia '98, Bristol, U.K., Sep. 1998, pp. 245-251.
Lu et al, "Structural Digital Signature for Image Authentication: An Incidental Distortion Resistant Scheme", IEEE Transactions on Multimedia, vol. 5, No. 2, Jun. 2003, pp. 161-173.
Lyon, "Computational Models of Neural Auditory Processing", IEEE International Conference on Acoustics, Speech, and Signal Processing, ICASSP '84, Date of Conference: Mar. 1984, vol. 9, pp. 41-44.
Ma Et El "Semantics modeling based image retrieval system using neural networks", 2005.
Marian Stewart B et al., "Independent component representations for face recognition", Proceedings of the SPIE Symposium on Electronic Imaging: Science and Technology; Conference on Human Vision and Electronic Imaging III, San Jose, California, Jan. 1998, pp. 1-12.
May et al, "The Transputer", Springer-Verlag Berlin Heidelberg 1989, vol. 41.
Mcnamara et al., "Diversity Decay in opportunistic Content Sharing Systems", 2011 IEEE International Symposium on a World of Wireless, Mobile and Multimedia Networks, pp. 1-3.
Morad et al., "Performance, Power Efficiency and Scalability of Asymmetric Cluster Chip Multiprocessors", Computer Architecture Letters, vol. 4, Jul. 4, 2005, pp. 1-4, XP002466254.
Nagy et al, "A Transputer, Based, Flexible, Real-Time Control System for Robotic Manipulators", UKACC International Conference on CONTROL '96, Sep. 2-5, 1996, Conference Publication No. 427, IEE 1996.
Natschlager et al., "The "Liquid Computer": A novel strategy for real-time computing on time series", Special Issue on Foundations of Information Processing of telematik, vol. 8, No. 1, 2002, pp. 39-43, XP002466253.
Odinaev et al, "Cliques in Neural Ensembles as Perception Carriers", Technion—Institute of Technology, 2006 International Joint Conference on neural Networks, Canada, 2006, pp. 285-292.
Ortiz-Boyer et al, "CIXL2: A Crossover Operator for Evolutionary Algorithms Based on Population Features", Journal of Artificial Intelligence Research 24 (2005) Submitted Nov. 2004; published Jul. 2005, pp. 1-48.
Pandya etal. A Survey on QR Codes: in context of Research and Application. International Journal of Emerging Technology and U Advanced Engineering. ISSN 2250-2459, ISO 9001:2008 Certified Journal, vol. 4, Issue 3, Mar. 2014 (Year: 2014).
Queluz, "Content-Based Integrity Protection of Digital Images", SPIE Conf. on Security and Watermarking of Multimedia Contents, San Jose, Jan. 1999, pp. 85-93.
Rui, Yong et al. "Relevance feedback: a power tool for interactive content-based image retrieval." IEEE Transactions on circuits and systems for video technology 8.5 (1998): 644-655.
Santos et al., "SCORM-MPEG: an Ontology of Interoperable Metadata for multimediaand E-Learning", 23rd International Conference on Software, Telecommunications and Computer Networks (SoftCom), 2015, pp. 224-228.
Scheper et al, "Nonlinear dynamics in neural computation", ESANN'2006 proceedings—European Symposium on Artificial Neural Networks, Bruges (Belgium), Apr. 26-28, 2006, d-side publication, ISBN 2-930307-06-4, pp. 1-12.
Schneider et al, "A Robust Content based Digital Signature for Image Authentication", Proc. ICIP 1996, Lausane, Switzerland, Oct. 1996, pp. 227-230.
Srihari et al., "Intelligent Indexing and Semantic Retrieval of Multimodal Documents", Kluwer Academic Publishers, May 2000, vol. 2, Issue 2-3, pp. 245-275.
Srihari, Rohini K. "Automatic indexing and content-based retrieval of captioned images" Computer 0 (1995): 49-56.
Stolberg et al ("Hibrid-SOC: A Multi-Core SOC Architecture for Multimedia Signal Processing" 2003).
Stolberg et al, "Hibrid-SOC: A Mul Ti-Core SOC Architecture for Mul Timedia Signal Processing", 2003 IEEE, pp. 189-194.
Theodoropoulos et al, "Simulating Asynchronous Architectures on Transputer Networks", Proceedings of the Fourth Euromicro Workshop On Parallel and Distributed Processing, 1996. PDP '96, pp. 274-281.

* cited by examiner

100

102

400

DETECTION OF VACANT PARKING SPACES

TECHNICAL FIELD

The present disclosure generally relates to detecting vacant parking spaces.

BACKGROUND

Vacant street parking slots are getting rare as the number of vehicles well exceeds the amount of street parking slots.

There is a growing need to learn in an efficient and dynamic manner which may locate allowable street parking slots.

BRIEF DESCRIPTION OF THE DRAWINGS

The embodiments of the disclosure will be understood and appreciated more fully from the following detailed description, taken in conjunction with the drawings in which.

DESCRIPTION OF EXAMPLE EMBODIMENTS

There may be provided a highly efficient method for. The method may learn the allowable street parking slots in a supervised manner, and even regardless of prior knowledge of traffic regulations, traffic signals, and the like—and thus is prone to errors that may result from obsolete traffic signs, errors in traffic signals, changes in parking regulations, changes in the environments, reconstructions works, and the like.

Figure 1:
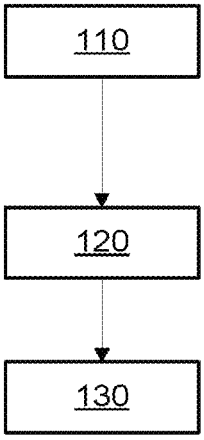
FIG. 1 is an example of a method.

FIG. 1 illustrates method 100 for detecting allowable street parking slots. A street parking slot is a parking slot that is fully within a street, partially within a street, or proximate (for example—up to 1-2 meters) to a border of the street.

An allowable street parking slot is a street parking slots that is allowable according to traffic laws and/or regulations.

Method 100 may start by step 110 of receiving, by a computerized allowable street parking slot locating (CASPSL) system, street static vehicles information from multiple vehicles.

The street static vehicle information is indicative of (a) locations of static vehicles that are located at least partially within one or more streets, (b) relationship information indicative of spatial relationships between the static vehicles and the one or more street borders; and (c) timing information regarding timings of sensing of the static vehicles.

The locations of the static vehicles may be provided in any coordinate system.

A relationship information that is related to a certain static vehicle may provide an indication about the spatial relationship between the static vehicle and a border of a street. The spatial relationship may indicate an angular relationship between the static vehicle and the border (for example—parallel, normal, oriented). The spatial relationship may also indicate a distance between the static vehicle and the border, whether the vehicle is parked in the street, only partially parked on the street, or parked on the pavement or otherwise not on the street.

The timing information is indicative of the time in which the static vehicle was sensed.

The street static vehicle information may be provided by multiple vehicles over significant period of times. The street static vehicle information has to be acquired from enough vehicles and during long enough period of time to be statistically significant—or otherwise reliable. Non-limiting examples are periods of time that exceed one or two weeks, one or two months and the like. Non-limiting examples of a minimal number of vehicles that should provide information may exceed 100, 200, 300, 1000 and even more. There may be a tradeoff between the number of vehicles and the length of the period of time. The period of time may also be long enough to provide information about periods of interest. For example—if the parking patterns may change on a daily basis then the period of time should exceed 1-2 weeks. Yet for another example—if the parking patterns may change on a weekly basis then the period of time should exceed 2-3 months.

Step 110 may be followed by step 120 of determining, by the CASPSL system, based on the street static vehicle information, allowable street parking slots metadata indicative of (a) locations of allowable street parking slots, (b) time windows of allowed parking in the allowable street parking slot, and (c) spatial relationships between the static vehicles and the one or more street borders.

Step 120 may include ignoring street static vehicles information regarding static vehicles that were static for less than a predefined period. The timing threshold may be one or two minutes, three minutes and the like. The timing threshold may change over time.

Step 120 may include calculating, based on the street static vehicle information, likelihoods of potential parking events, wherein each potential parking event involves a presence of a static vehicle at a certain location, at a certain point in time and at a certain spatial relationship to a street border.

The potential parking events may be clustered so that events with similar parameters will belong to a single cluster and the likelihood of potential events may be the likelihood of potential parking event clusters.

The similarity between the potential parking events may be defined in various manners and allow various tolerances. The variable (a), (b) and (c) may classified to classes and potential parking events that belong to the same three classes may be regarded as similar to each other.

For example—the angular relationships between the static vehicle and the border may be classified to one out of a limited number of classes (for example—about parallel, about normal, and about 45 degrees). The same applied to the distance to the border and to the overlap between the vehicle and the street.

For example—the points of time may be classified to time windows of certain duration (for example 5 till 15 minutes).

For example—the locations within a same area (for example—having a length of 2-3 meters) the same meters may be classified to the same class.

The determining of the allowable street parking slots metadata may be responsive to the likelihoods of potential parking events.

The determining may include ignoring potential parking events having an insignificant likelihood of occurrence. For example—step 120 may include calculating a statistical distribution of potential parking events and ignoring potential parking events that and insignificant—below a certain threshold. For example—when a static vehicle is located at a certain location at a certain time window (for example of few hours) only one a month—it may be assumed that the certain location is not an allowable street parking slot.

Step 120 may include determining that a certain location is an allowable street parking slot having a certain time window of allowed parking when a likelihood of a potential parking events that involve a presence of a static vehicle at the certain location and at any point in time within the certain time window exceed a significance threshold. The significance threshold may be determined in various manners. For example—the significance threshold may be used to reject potential parking events that have a likelihood below 10, 20, 30, 40 percent and the like.

Step 120 may also include detecting a type of a vehicle (motorcycles, medium-small vehicles, trucks, and the like). This may assist in finding, for example, whether some types of vehicles (for example trucks) are prohibited from parking at certain parking street slots.

It should be noted that some regions (region may include one or more street, one or more neighborhoods, one or more cities, one or more counties, one or more countries) may be populated with vehicles that other regions. This may affect the probability of the occurrence potential parking events. Step 120 may include compensating for differences between different region. Thus—a likelihood of occurrence potential parking event may amended based on the overall traffic within the region, the overall amount of vehicles (per region) that sent to the CASPSL system the street static vehicles information, and the like.

Step 120 may be followed by step 130 of storing and/or transmitting the allowable street parking slots metadata.

The allowable street parking slots metadata may be received by one or more vehicles and may assists these vehicles in searching for vacant allowable street parking slots.

Figure 2:
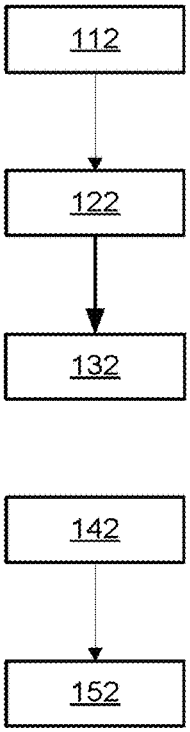
FIG. 2 is an example of a method.

FIG. 2 illustrates method 102. Method 102 is executed by a vehicle.

Method 102 may include step 112 of acquiring images of scenes by one or more sensor of a vehicle. The acquisition may take place while the vehicle is driving. The images may be a part of a video stream. The images may be spaced apart still images.

Step 112 may be followed by step 122 of processing the images to generate street static vehicle information is indicative of (a) locations of static vehicles that are located at least partially within one or more streets, (b) relationship information indicative of spatial relationships between the static vehicles and the one or more street borders; and (c) timing information regarding timings of sensing of the static vehicles.

The vehicle may determine that a vehicle is a static vehicle based on the spatial relationship between the vehicle and the static vehicle. If, for example the vehicle is moves while acquiring images (spaced apart in time) of another vehicle that does not move then the other vehicle may be regarded as a static vehicle.

Step 122 may be followed by step 132 of transmitting the street static vehicle information to the CASPSL system.

The vehicle (or yet another vehicle) may also perform the following steps:

Step 142 of receiving the allowable street parking slots metadata indicative of (a) locations of allowable street parking slots, (b) time windows of allowed parking in the allowable street parking slot, and (c) spatial relationships between the static vehicles and the one or more street borders.

Step 152 of utilizing the allowable street parking slots metadata—for example storing the allowable street parking slots metadata, providing an indication to a driver of the vehicle of allowable street parking slots in his vicinity and/or near a target location, and the like.

The allowable street parking slots metadata may be fed to an autonomous driving system that may use this metadata when there is a need to park the vehicle. The autonomous driving system may be arranged to locate a vacant allowable street parking slot and may park the vehicle at a manner that fits the spatial relationship (related to the allowable street parking slot) between the static vehicle and the one or more street borders.

Figure 3:
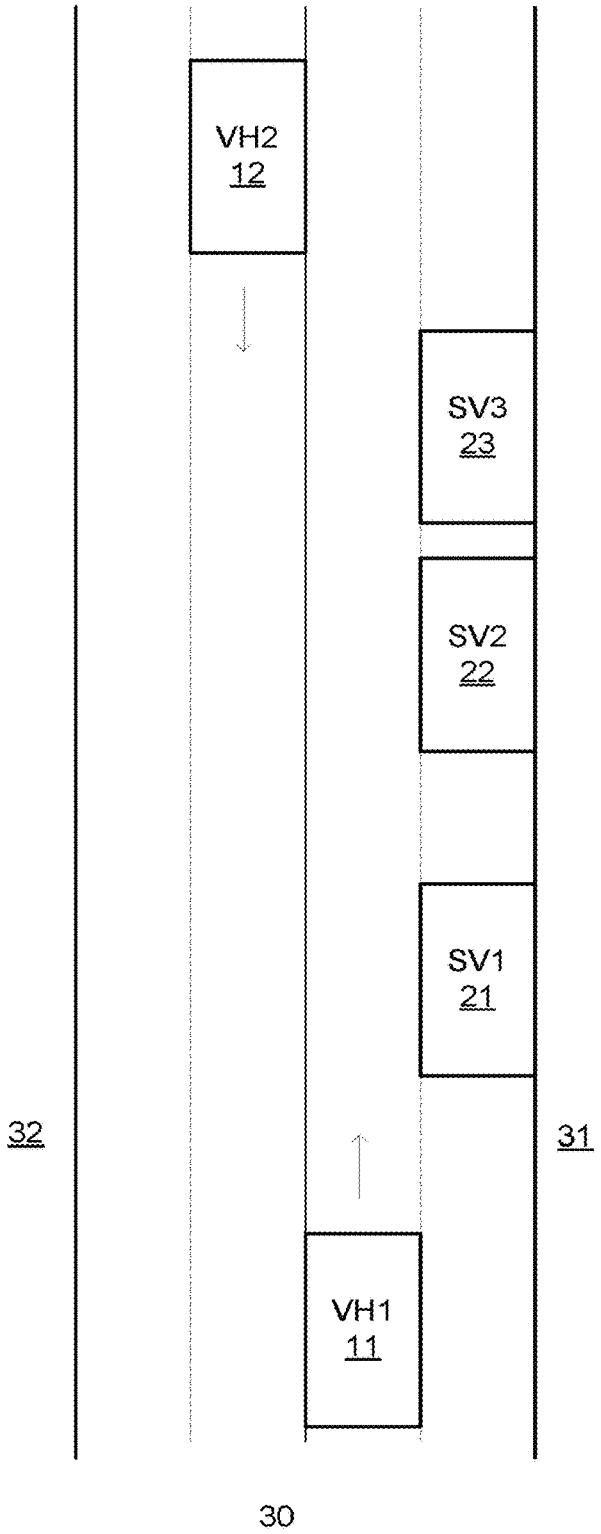
FIG. 3 is an example of a scenario.

FIG. 3 illustrates an example of first and second vehicles VH1 11 and VH2 that drive at opposite directions from each other and at different lanes of a bi-directional road 30 that include two lanes per direction. Both vehicles images three static vehicles SV1 21, SV2 22, and SV3 23 that are parked on the rightmost lane of the road, are parallel to the border of the road (border between road 30 and sidewalk 31).

Figure 4:
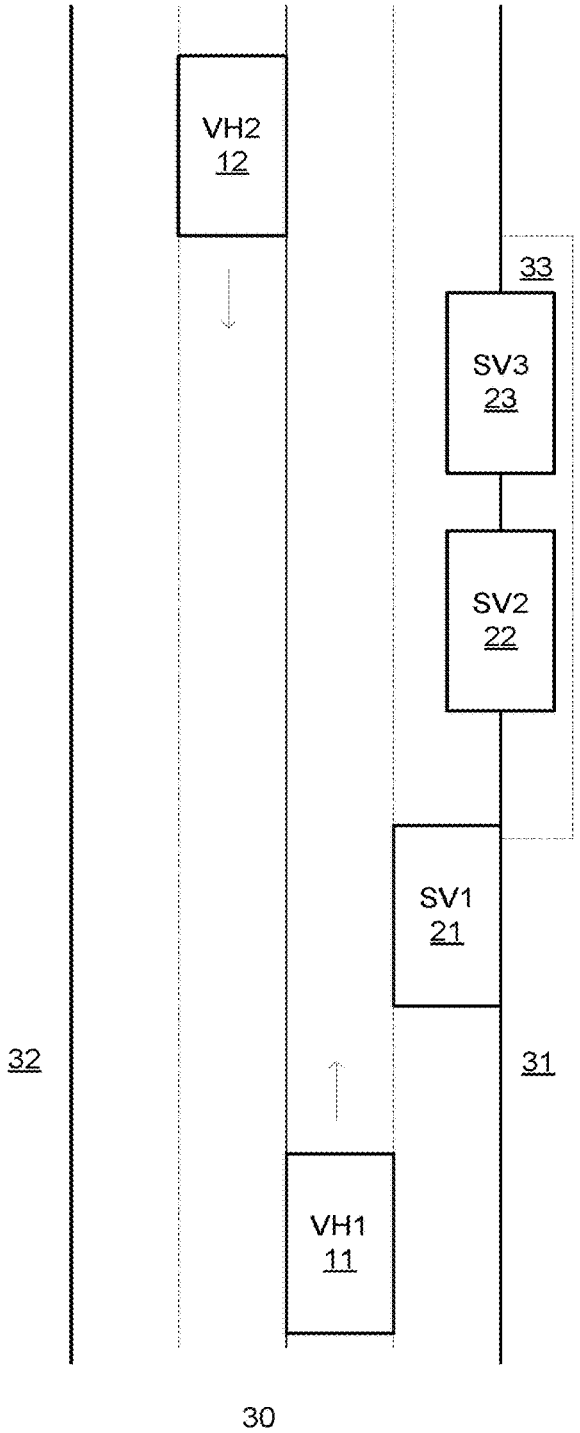
FIG. 4 is an example of a scenario.

FIG. 4 illustrates yet another scenario in which the first static vehicle SV1 21 is parked on the road and the second and third static vehicle SV2 22 and SV3 23 are parallel to the border of the road but are parked only in part on the road—as about a half of these vehicle is parked on the sidewalk—which may indicate that part 33 of the sidewalk is allocated for parking.

Figure 5:
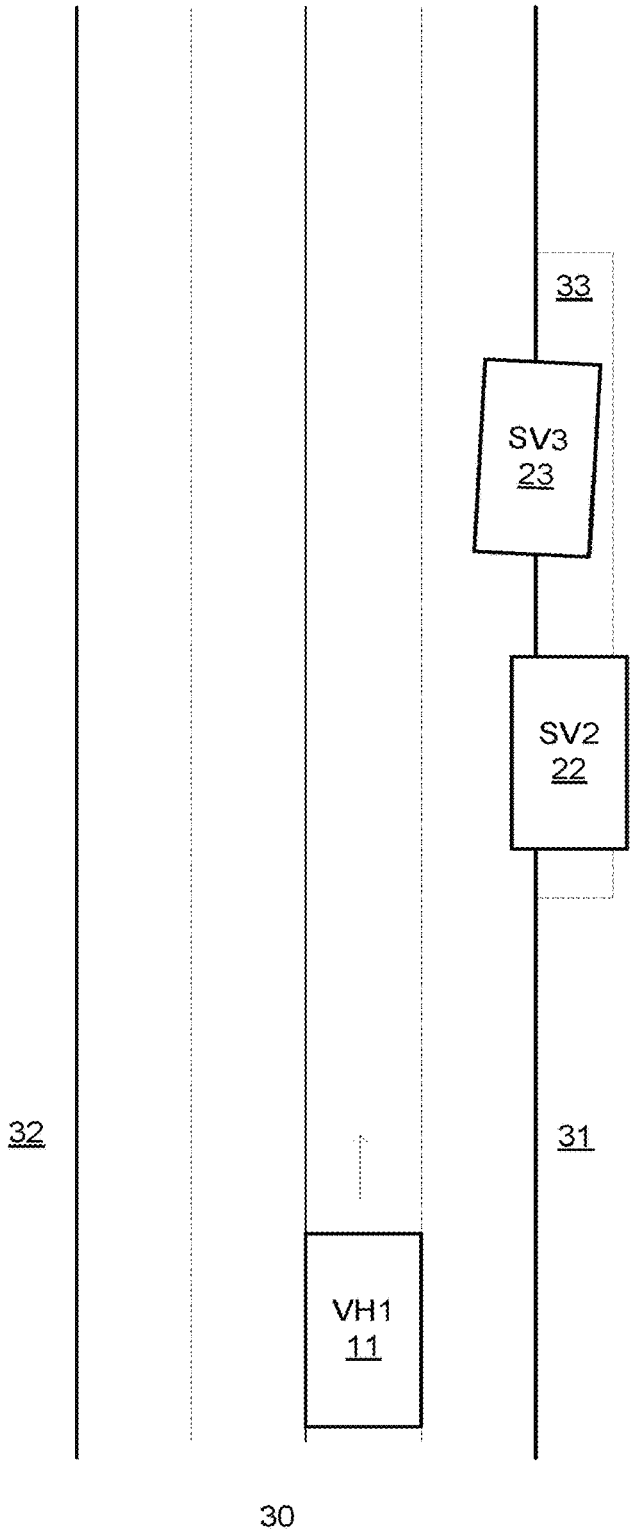
FIG. 5 is an example of a scenario.

FIG. 5 illustrates yet another scenario in which only two vehicles are parked to the side of the road. The third static vehicle SV3 23 is slightly oriented in relation to the border. The second static vehicle SV2 22 is parallel to the border of the road but is mostly parked on the sidewalk. About half of the third static vehicle is parked only in part on the road. This still may indicate that part 33 of the sidewalk is allocated for parking.

Assuming that the scenarios of FIGS. 4 and 5 were acquired at the same time window—then if at a certain time window the scenario of FIG. 5 occurs about 20 times more (or other factor) than the scenario of FIG. 4 (or otherwise the likelihood of the occurrence of having a vehicle parked at the location of static vehicle VH1 in FIG. 4)—the CASPSL system may determine that the location of static vehicle VH1 in FIG. 4 is not an allowable street parking slot (within the certain time window).

Figure 6:
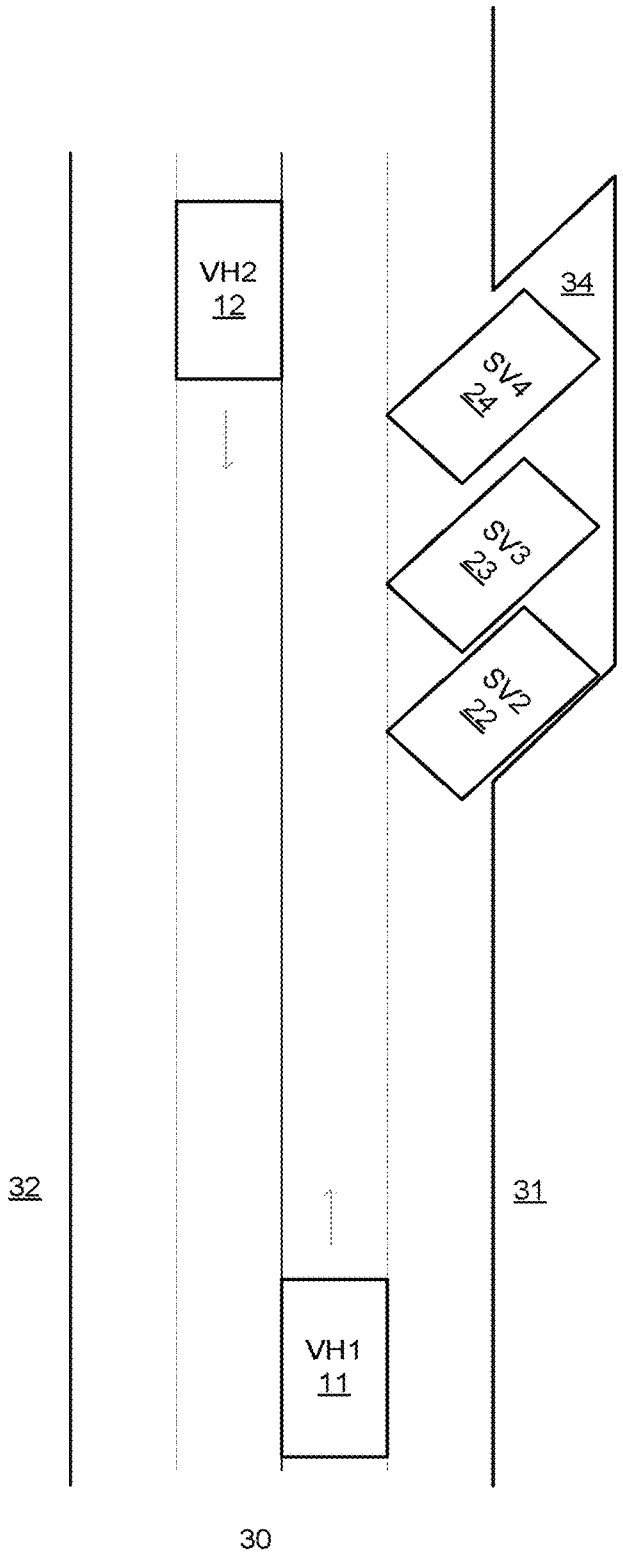
FIG. 6 is an example of a scenario.

FIG. 6 illustrates yet another scenario in which the first static vehicle SV1 21, second static vehicle SV2 22 and third static vehicle SV3 23 are all oriented to the road by about 45 degrees and are parked only in part on the rightmost traffic lane—this may indicate that part 34 of the road is a parking bay.

Figure 7:
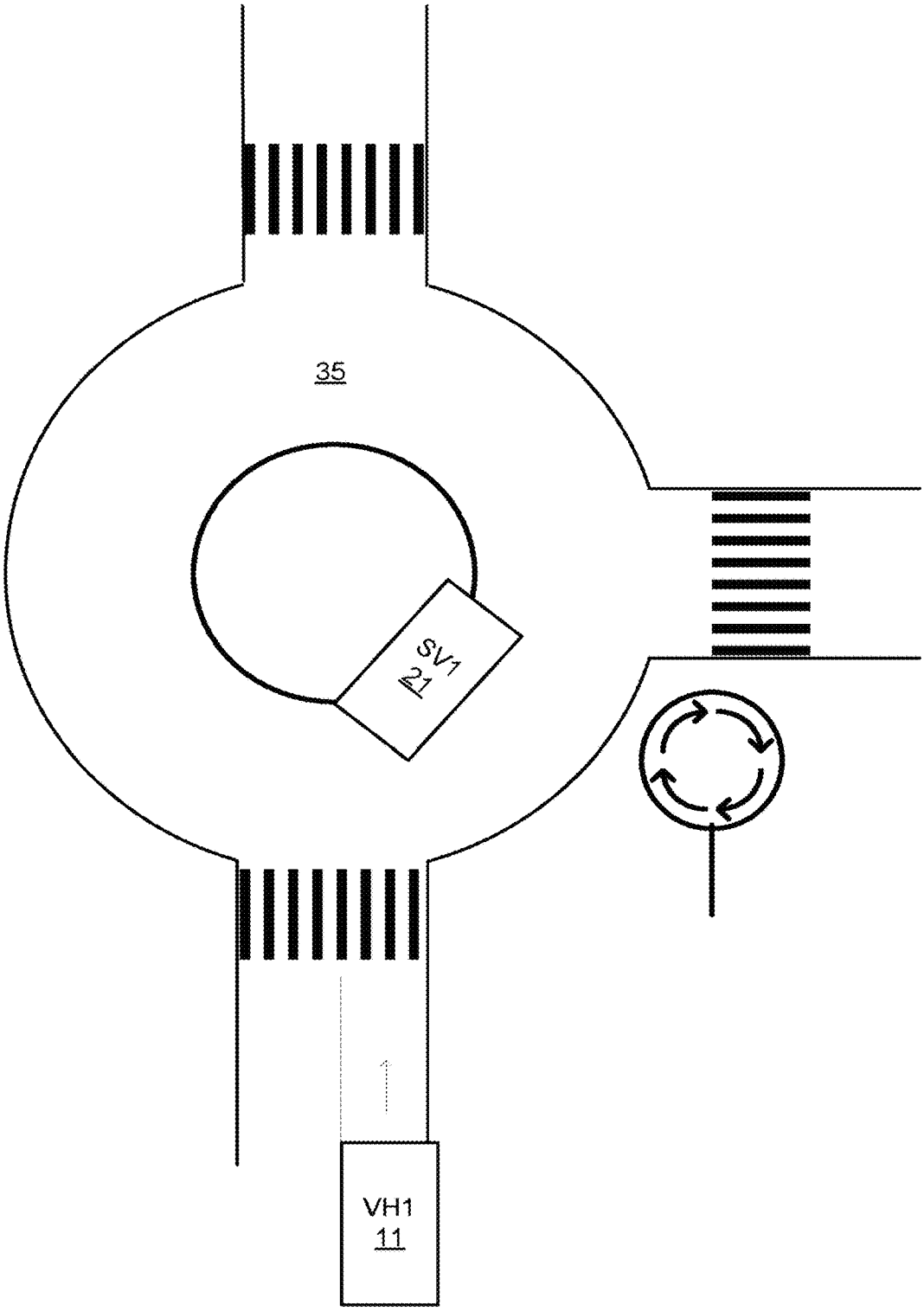
FIG. 7 is an example of a scenario.

FIG. 7 illustrates an atypical scenario in which first static vehicle SV1 21 is parked at the middle of a roundabout 35.

Figure 8:
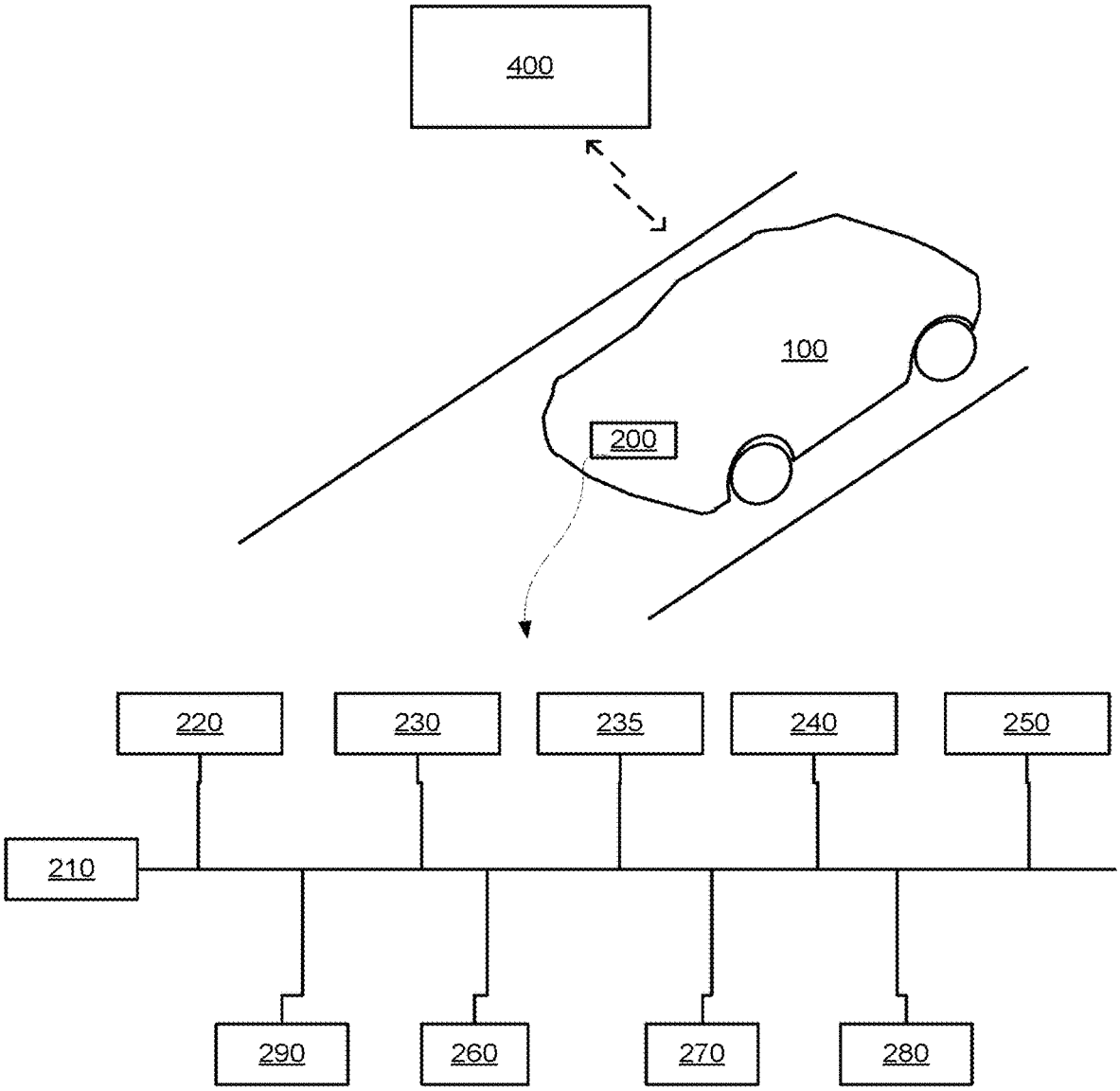
FIG. 8 is an example of a vehicle and its environment.
Figure 9:
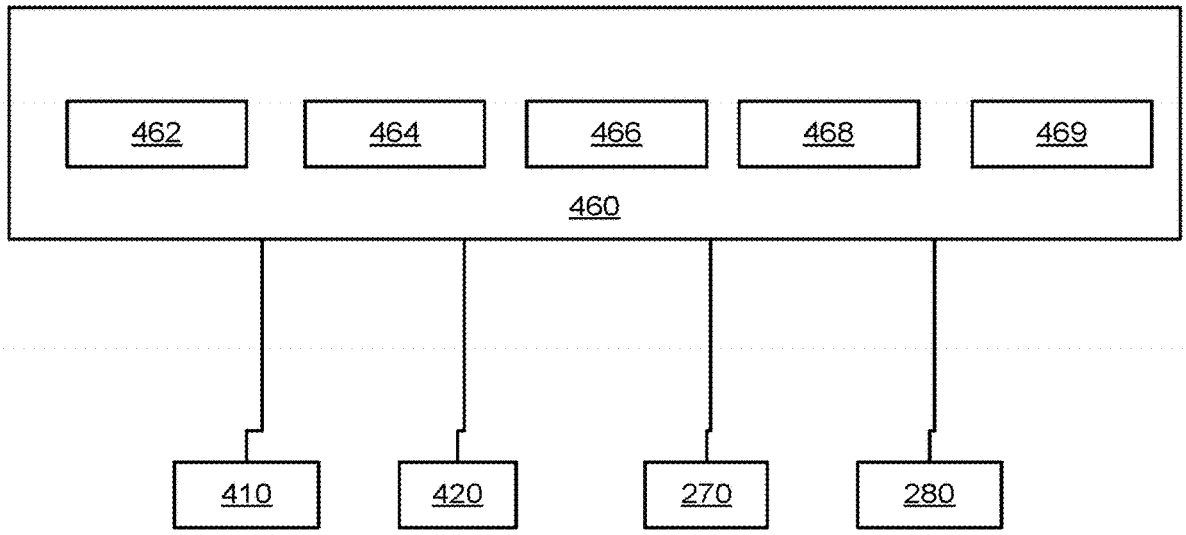
FIG. 9 is an example of a CASPSL system.

FIG. 8 illustrates a vehicle 100 that includes a driving system 200 (hereinafter also referred to as system 200), constructed and implemented in accordance with embodiments described herein. Driving system 200 comprises processing circuitry 210, input/output (I/O) module 220, camera 230, speed sensor 235, telemetry ECU 240, accelerometer 250, autonomous driving manager 260, database 270, advance driving assistance (ADAS) manager 280 and street static vehicles information (SSVI) generator 290.

It should be noted that the vehicle may include (a) other systems or modules or units and/or (b) additional systems or modules or units, (c) and/or fewer systems or modules or units. For example—vehicle 100 may include only one out of autonomous driving manager 260 and ADAS manager 280.

Autonomous driving manager 260 may be instantiated in a suitable memory for storing software such as, for example, an optical storage medium, a magnetic storage medium, an electronic storage medium, and/or a combination thereof. It will be appreciated that system 200 may be implemented as an integrated component of an onboard computer system in a vehicle. Alternatively, system 200 may be implemented and a separate component in communication with the onboard computer system. It will also be appreciated that in the interests of clarity, while system 200 may comprise additional components and/or functionality e.g., for autonomous driving of vehicle 100, such additional components and/or functionality are not depicted in FIG. 2 and/or described herein.

Processing circuitry 210 may be operative to execute instructions stored in memory (not shown). For example, processing circuitry 210 may be operative to execute autonomous driving manager 260 and/or may be operative to execute SSVI generator 290 and/or may be operative to execute ADAS manager 280.

It will be appreciated that processing circuitry 210 may be implemented as a central processing unit (CPU), and/or one or more other integrated circuits such as application-specific integrated circuits (ASICs), field programmable gate arrays (FPGAs), full-custom integrated circuits, etc., or a combination of such integrated circuits. It will similarly be appreciated that system 200 may comprise more than one instance of processing circuitry 210. For example, one such instance of processing circuitry 210 may be a special purpose processor operative to execute autonomous driving manager 260 to perform some, or all, of the functionality of system 200 as described herein.

I/O module 220 may be any suitable communications component such as a network interface card, universal serial bus (USB) port, disk reader, modem or transceiver that may be operative to use protocols such as are known in the art to communicate either directly, or indirectly, with other elements, such as, for example, CASPSL system 400, camera 230, speed sensor 235, telemetry ECU 240, and/or accelerometer 250. As such, I/O module 220 may be operative to use a wired or wireless connection to connect to CASPSL system 400 via a communications network such as a local area network, a backbone network and/or the Internet, etc. I/O module 220 may also be operative to use a wired or wireless connection to connect to other components of system 200, e.g., camera 230, telemetry ECU 240, and/or accelerometer 250. It will be appreciated that in operation I/O module 220 may be implemented as a multiplicity of modules, where different modules may be operative to use different communication technologies. For example, a module providing mobile network connectivity may be used to connect to CASPSL system 400, whereas a local area wired connection may be used to connect to camera 230, telemetry ECU 240, and/or accelerometer 250.

In accordance with embodiments described herein, camera 230, telemetry ECU 240, speed sensor 235, and accelerometer 250 represent implementations of sensor(s). It will be appreciated that camera 230, telemetry ECU 240, and/or accelerometer 250 may be implemented as integrated components of vehicle 100 and may provide other functionality that is the interests of clarity is not explicitly described herein. As described hereinbelow, system 200 may use information about a current driving environment as received from camera 230, telemetry ECU 240, and/or accelerometer 250 to determine an appropriate driving policy for vehicle 100.

Autonomous driving manager 260 may be an application implemented in hardware, firmware, or software that may be executed by processing circuitry 210 to provide driving instructions to vehicle 100. For example, autonomous driving manager 260 may use images received from camera 230 and/or telemetry data received from telemetry ECU 240 to determine an appropriate driving policy for arriving at a given destination and provide driving instructions to vehicle 100 accordingly. It will be appreciated that autonomous driving manager 260 may also be operative to use other data sources when determining a driving policy, e.g., maps of potential routes, traffic congestion reports, etc. The autonomous driving manager 260 may use allowable street parking slots metadata stored in database 270 to search for vacant allowable street parking slots and park the vehicle at one of the vacant allowable street parking slot at a manner (for example time window, spatial relationship, time window) according to the allowable street parking slots metadata.

ADAS manager 280 may be an application implemented in hardware, firmware, or software that may be executed by processing circuitry 210 to assist a driver in driving the vehicle 100. The ADAS manager may assist the driver in any manner known in the art—for example—plan a suggested driving path, provide collision alerts, obstacle alerts, cross lane alerts, and the like. The ADAS manager 280 may provide indication to a driver (either upon request or else) about allowable street parking slots based on the allowable street parking slots metadata. The ADAS manager may also locate an allowable street parking slot that is vacant.

SSVI generator 290 may receive information from one or more sensors (for example from camera 230 and speed sensor 235) and apply image processing to detect static vehicles. The speed sensor may be required to determine whether the vehicle sensed by the camera 230 is static—although the movement of the sensed vehicle can also be learnt from the images—for example by tracking a relationship between the sensed vehicle and the background.

Reference is now made to FIG. 8 which is a block diagram of an exemplary CASPSL system 400 (such as a server, multiple servers), constructed and implemented in accordance with embodiments described herein. CASPSL system 400 comprises processing circuitry 410, input/output (I/O) module 420, allowable street parking slot metadata generator 460, and database 470.

Allowable street parking slot metadata generator 460 may be instantiated in a suitable memory for storing software such as, for example, an optical storage medium, a magnetic storage medium, an electronic storage medium, and/or a combination thereof.

Processing circuitry 410 may be operative to execute instructions stored in memory (not shown). For example, processing circuitry 410 may be operative to execute allowable street parking slot metadata generator 460. It will be appreciated that processing circuitry 410 may be implemented as a central processing unit (CPU), and/or one or more other integrated circuits such as application-specific integrated circuits (ASICs), field programmable gate arrays (FPGAs), full-custom integrated circuits, etc., or a combination of such integrated circuits. It will similarly be appreciated that server 400 may comprise more than one instance of processing circuitry 410. For example, one such instance of processing circuitry 410 may be a special purpose processor operative to execute allowable street parking slot metadata generator 460 to perform some, or all, of the functionality of server 400 as described herein.

I/O module 420 may be any suitable communications component such as a network interface card, universal serial bus (USB) port, disk reader, modem or transceiver that may be operative to use protocols such as are known in the art to communicate either directly, or indirectly, with system 200 (FIG. 2). As such, I/O module 420 may be operative to use a wired or wireless connection to connect to system 200 via a communications network such as a local area network, a backbone network and/or the Internet, etc. It will be appreciated that in operation I/O module 420 may be implemented as a multiplicity of modules, where different modules may be operative to use different communication technologies. For example, a module providing mobile network connectivity may be used to connect wirelessly to one instance of system 200, e.g., one vehicle 100, whereas a local area wired connection may be used to connect to a different instance of system 100, e.g., a different vehicle 100.

Allowable street parking slot metadata generator 460 may be an application implemented in hardware, firmware, or software that may be executed by processing circuitry 410 to generate allowable street parking slots metadata. For example, allowable street parking slot metadata generator 460 may use street static vehicles information in reports received from vehicles 100 to generate the allowable street parking slots metadata.

The allowable street parking slot metadata generator 460 may execute method 100.

It will be appreciated that allowable street parking slot metadata generator 460 may also be operative to use other data sources when detecting street parking slots such as metadata regarding parking rules, information about parking signs, and the like.

As depicted in FIG. 8, allowable street parking slot metadata generator 460 may include: (i) potential parking event detector 462 that is configured to detect, out of the street static vehicles information, potential parking events, (ii) potential parking event cluster module 464 for clustering potential parking events that are similar to each other and finding a cluster representative from each cluster, (iii) likelihood calculator 466 for calculating the likelihood of occurrence of cluster representatives from multiple clusters, (iv) allowable street parking slot finder 468 for determining, based on these likelihoods, allowable parking events (out of the potential parking events), and (v) metadata module 469 for providing, based on the allowable events, the allowable street parking slot metadata.

It should be noted that the allowable street parking slot metadata generator 460 may have other modules. For example—the allowable street parking slot metadata generator 460 may not have the potential parking event cluster module 464—but may have a grouping module or a classifier—or may not include any of such modules. Yet for another example—the likelihood calculator 466 may be configured to calculate the likelihood of occurrences of potential parking events that may differ from cluster representatives.

Each one of potential parking event detector 462, potential parking event cluster module 464, likelihood calculator 466, allowable street parking slot finder 468 and metadata module 469 may be an application implemented in hardware, firmware, or software that may be executed by processing circuitry 410.

I claim:

1. A method for detecting allowable street parking slots, the method comprises:

receiving, by a computerized allowable street parking slot locating (CASPSL) system, street static vehicles information from multiple vehicles; wherein the street static vehicle information is indicative of (a) locations of static vehicles that are located at least partially within one or more streets, (b) relationship information indicative of spatial relationships between the static vehicles and the one or more street borders; and (c) timing information regarding timings of sensing of the static vehicles; and determining, by the CASPSL system, based on the street static vehicle information, allowable street parking slots metadata indicative of (a) locations of allowable street parking slots, and (b) time windows of allowed parking in the allowable street parking slot, and (c) spatial relationships between the static vehicles and the one or more street borders; wherein the determining of the allowable street parking slots metadata comprises determining likelihoods of occurrences of potential parking events, wherein likelihoods of occurrences of potential street parking events located in a region are responsive to an overall number of vehicles within the region that sent the street static vehicles information.

2. The method according to claim 1 wherein the determining comprises ignoring street static vehicles information regarding static vehicles that were static for less than a predefined period.

3. The method according to claim 1 wherein each potential parking event involves a presence of a static vehicle at a certain location, at a certain point in time and at a certain spatial relationship to a street border.

4. The method according to claim 1 wherein the allowable street parking slots metadata is also indicative of whether a truck is allowed to park in the parking slots.

5. The method according to claim 1 wherein the determining comprises ignoring potential parking events having an insignificant likelihood of occurrence.

6. The method according to claim 1 comprising determining an allowability of potential parking events based on likelihoods of an occurrence of the events.

7. The method according to claim 1 comprises determining that a certain location is an allowable street parking slot having a certain time window of allowed parking when a likelihood of a potential parking events that involve a presence of a static vehicle at the certain location and at any point in time within the certain time window exceed a significance threshold.

8. The method according to claim 1 wherein the spatial relationships between the static vehicles and the one or more street borders comprise angular information having values selected of three different values.

9. The method according to claim 1 wherein the likelihoods of occurrences of potential street parking events located in a region are also responsive to an overall traffic within the region.

10. A non-transitory computer readable medium that stores instructions for:

receiving, by a computerized allowable street parking slot locating (CASPSL) system, street static vehicles information from multiple vehicles; wherein the street static vehicle information is indicative of (a) locations of static vehicles that are located at least partially within one or more streets, (b) relationship information indicative of spatial relationships between the static vehicles and the one or more street borders; (c) timing information regarding timings of sensing of the static vehicles; and determining, by the CASPSL system, based on the street static vehicle information, allowable street parking slots metadata indicative of (a) locations of allowable street parking slots, and (b) time windows of allowed parking in the allowable street parking slot, and (c) spatial relationships between the static vehicles and the one or more street borders; wherein the determining of the allowable street parking slots metadata comprises determining likelihoods of occurrences of potential parking events, wherein likelihoods of occurrences of potential street parking events located in a region are responsive to an overall number of vehicles within the region that sent the street static vehicles information.

11. The non-transitory computer readable medium according to claim 10 wherein the determining comprises ignoring street static vehicles information regarding static vehicles that were static for less than a predefined period.

12. The non-transitory computer readable medium according to claim 10 wherein each potential parking event involves a presence of a static vehicle at a certain location, at a certain point in time and at a certain spatial relationship to a street border.

13. The non-transitory computer readable medium according to claim 10 wherein the allowable street parking slots metadata is also indicative of whether a truck is allowed to park in the parking slots.

14. The non-transitory computer readable medium according to claim 10 wherein the determining comprises ignoring potential parking events having an insignificant likelihood of occurrence.

15. The non-transitory computer readable medium according to claim 10 comprising determining an allowability of potential parking events based on likelihoods of an occurrence of the events.

16. The non-transitory computer readable medium according to claim 10 comprises determining that a certain location is an allowable street parking slot having a certain time window of allowed parking when a likelihood of a potential parking events that involve a presence of a static vehicle at the certain location and at any point in time within the certain time window exceed a significance threshold.

17. The non-transitory computer readable medium according to claim 10 wherein the spatial relationships between the static vehicles and the one or more street borders comprise angular information having values selected of three different values.

18. The non-transitory computer readable medium according to claim 10 the likelihoods of occurrences of potential street parking events located in a region are also responsive to an overall traffic within the region.

19. The non-transitory computer readable medium according to claim 10 that stores instructions for (i) clustering potential parking events that are similar to each other and finding a cluster representative from each cluster, calculating the likelihood of occurrence of cluster representatives from multiple clusters, and determining, based on these likelihoods, the allowable parking events.

20. A method for parking an autonomous vehicle, the method comprises:

feeding an autonomous driving system of a vehicle with an allowable street parking slots metadata; wherein a determining of the allowable street parking slots metadata comprises determining likelihoods of occurrences of potential parking events, wherein likelihoods of occurrences of potential street parking events located in a region are responsive to an overall number of vehicles within the region that sent street static vehicles information to a computerized allowable street parking slot locating (CASPSL) system that determined the allowable parking slots metadata; the allowable street parking slots metadata is indicative of (a) locations of allowable street parking slots, and (b) time windows of allowed parking in the allowable street parking slot, and (c) spatial relationships between static vehicles and one or more street borders;

locating, by the autonomous driving system, a vacant allowable street parking slot; and parking the vehicle, by the autonomous driving system, at a manner that fits the spatial relationship related to the allowable street parking slot between the static vehicle and the one or more street borders.

21. The method according to claim 20 wherein the allowable street parking slots metadata is indicative of an angular relationships between the static vehicles and the one or more street borders.

22. The method according to claim 20 wherein the allowable street parking slots metadata is indicative of at least one typical vehicles type per allowable street parking slot.

* * * * *